United States Patent [19]

Kato et al.

[11] Patent Number: 4,971,950

[45] Date of Patent: Nov. 20, 1990

[54] SUPPORT SHEET FOR THERMAL TRANSFER IMAGE-RECEIVING SHEET AND METHOD OF PRODUCING SAME

[75] Inventors: Masaru Kato; Toshihiro Minato; Toshikazu Nagura; Susumu Hasegawa, all of Tokyo; Kenji Yasuda, Yachiyo, all of Japan

[73] Assignee: Oji Paper Co., Ltd., Tokyo, Japan

[21] Appl. No.: 367,075

[22] Filed: Jun. 16, 1989

[30] Foreign Application Priority Data

| | | | |
|---|---|---|---|
| Jun. 20, 1988 | [JP] | Japan | 63-150017 |
| Jul. 28, 1988 | [JP] | Japan | 63-186707 |
| Jul. 28, 1988 | [JP] | Japan | 63-186708 |
| Aug. 15, 1988 | [JP] | Japan | 63-201903 |

[51] Int. Cl.[5] ..... B41M 5/035; B41M 5/26

[52] U.S. Cl. ..... 503/227; 8/471; 428/195; 428/516; 428/523; 428/910; 428/913; 428/914

[58] Field of Search ..... 8/471; 428/211, 513, 428/913, 914, 195, 332, 334–336, 516, 523, 910; 503/227

[56] References Cited

U.S. PATENT DOCUMENTS

| | | | |
|---|---|---|---|
| 4,075,050 | 2/1978 | Takashi et al. . | |
| 4,318,950 | 3/1982 | Takashi et al. . | |
| 4,572,860 | 2/1986 | Nakamura et al. . | |
| 4,615,938 | 10/1986 | Hotta et al. . | |
| 4,727,055 | 2/1988 | Aoyagi | 503/214 |
| 4,778,282 | 10/1988 | Ito et al. . | |

FOREIGN PATENT DOCUMENTS

| | | |
|---|---|---|
| 0234563 | 9/1987 | European Pat. Off. . |
| 0312637 | 4/1989 | . |
| 61-186474 | 11/1986 | Japan . |
| 2217866 | 11/1989 | United Kingdom . |

OTHER PUBLICATIONS

Patent Abstracts of Japan; vol. 12, No. 160 (M-697)(3007) 5/14/88 & JP-A-62 278088.

Patent Abstracts of Japan; vol. 12, No. 160 (M-697)(3007) 5/14/88 & JP-A-62 278087.

Patent Abstracts of Japan; vol. 11, No. 295 (M-626)(2742) 9/24/87 & JP-A-62 87390.

*Primary Examiner*—Bruce H. Hess

*Attorney, Agent, or Firm*—Armstrong, Nikaido, Marmelstein, Kubovcik & Murray

[57] ABSTRACT

A support sheet useful for a thermal transfer image receiving sheet having a high resistance to thermal curling and capable of recording clear and uniform images or pictures thereon, comprises a sheet substrate with a thickness of 20 to 300 μm, and multilayer front and back surface coating plastic films each comprising a pigment and a polyolefin resin, each having at least one bi-axially oriented base layer, and bonded to the sheet substrate, and satisfies the following relationships:

$$S_1/S_2 \leq \frac{1}{2}$$

$$S_3 < S_1$$

wherein $S_1$ = heat shrinkage of the front surface coating film, $S_2$ = heat shrinkage of the back surface coating film and $S_3$ = heat shrinkage of the sheet substrate, determined at 100°±2° C. for 10 minutes in accordance with JIS K-6734-1975.

16 Claims, 2 Drawing Sheets

SUPPORT SHEET FOR THERMAL TRANSFER IMAGE-RECEIVING SHEET AND METHOD OF PRODUCING SAME

BACKGROUND OF THE INVENTION (1) Field of the Invention

The present invention relates to a support sheet for a thermal transfer image-receiving sheet and a method of producing same. More particularly, the present invention relates to a support sheet useful for thermal transfer full colored image-receiving sheets, thermal sensitive image-recording sheets, and thermal printing sheets, especially sublimating dye-thermal transfer image-receiving sheets, capable of receiving thermally transferred dye or ink images thereon in a clear and sharp image from without thermal curling thereof, and capable of recording thereon continuous tone full colored images or pictures at a high resolution and a high tone reproduction.

(2) Description of the Related Arts

It is known that new types of color printers, for example, relatively compact thermal record printing systems having a thermal head, enable printing of clear colored images or pictures by thermal transfer of the colored images or pictures of a thermomelting ink or sublimating dye onto an image-receiving sheet. There is great interest in the further development and utilization of these printing systems, especially the sublimating dye colored image or picture-thermal transfer printing systems.

In the operation of the sublimating dye image or picture-thermal transfer printing system, an image-receiving sheet having a polyester resin layer, on which the sublimated dye is easily dyed, is superimposed on an ink sheet comprising a support sheet consisting of a thin plastic sheet and a sublimating dye ink layer formed on a surface of the support sheet, in a manner such that the surface of the polyester resin layer of the image-receiving sheet comes into contact with the surface of the ink layer of the ink sheet, and the ink sheet is partly heated imagewise by a thermal head in accordance with electric signals corresponding to the images or pictures to be printed, to thermally transfer the ink images or pictures composed of the sublimated dye, and having a color density corresponding to the amount of heat applied to the ink sheet on the polyester resin layer of the image-receiving sheet.

It is also known that a support sheet comprising a sheet substrate and a coating layer formed by bonding a bi-axially drawn plastic film consisting of a mixture of an inorganic pigment and a polyolefin resin and having a multilayered structure to the sheet substrate surface enables thermal transfer image-receiving sheets to receive thermally transferred images or pictures having high quality from a printing system having a thermal head.

In the image-receiving sheet for the sublimating dye thermal transfer printing system, the above-mentioned support sheet is coated with a thermal transfer image-receiving layer comprising, as a principal component, a polyester resin.

The record sheet or image-receiving sheet having the above-mentioned support sheet has an even thickness, a high softness, and lower thermal conductivity than that of paper composed of cellulose fibers, and therefore, is because images or pictures having a high uniformity and color density can be formed thereon. Nevertheless, where the coating layer in the support sheet is formed from a bi-axially drawn plastic film comprising, as a principal component, a polyolefin, for example, polypropylene resin, and having a multilayered structure, and ink or dye images or pictures are thermally transferred by heat from a thermal head to the polyester resin coating layer in the image-receiving sheet, the multilayer structured polyolefin resin coating film in the support sheet is heated by the thermal head so that a drawing stress held in the polyolefin resin coating film is released, and thus the polypropylene resin coating film layer shrinks. This shrinkage of the polyolefin resin coating layer causes the image-receiving sheet to be curled and a number of wrinkles to be formed thereon, so that the forwarding of the sheet in the printing system is hindered by the curls or wrinkles on the sheet and the resultant prints have a reduced commercial value.

To eliminate the above-mentioned disadvantages, a new type of support sheet was provided by coating two surfaces of a sheet substrate having a relatively small heat shrinkage with the multilayer-structured plastic coating films. This type of the support sheet effectively prevents the formation of wrinkles on the image-receiving sheet due to the heat shrinkage of the plastic coating films, but since two coating films having different heat shrinkages are laminated on a sheet substrate, the resultant image-receiving sheet is naturally not free from curl-formation. Especially, in the sublimating dye thermal transfer printing system, a large quantity of heat is applied to the image-receiving sheet, and therefore, the above-mentioned problems often occur on the image-receiving sheet.

The sublimating dye thermal transfer printing system is a mainstream printing system among small size non-impact type full colored image-printing systems, and thus is often used as a printer for small size electronic cameras or video printers. Therefore, there is an urgent demand for the provision of a new type of support sheet for a thermal transfer image-receiving sheet which can form clear images or pictures thereon without thermal deformation thereof, even when used for the sublimating dye thermal transfer printing system in which a large quantity of heat is applied to the image-receiving sheet.

SUMMARY OF THE INVENTION

An object of the present invention is to provide a support sheet useful for a thermal transfer image-receiving sheet applicable to various types of thermal transfer printers including a sublimating dye thermal transfer printing system and capable of forming clear images or pictures thereon without undesirable curling and wrinkle-forming due to heating, and a method of producing same.

The above-mentioned object can be obtained by the support sheet of the present invention for a thermal transfer image-receiving sheet, which comprises:

(A) a sheet substrate having a thickness of 20 to 300 μm;

(B) a front surface coating film layer consisting of a multilayer drawn plastic film comprising, as a main component, a mixture of a polyolefin resin with an inorganic pigment, having at least one biaxially oriented base layer and formed on and bonded to a front surface of the sheet substrate; and (C) a back surface coating film layer consisting of a multilayer plastic film comprising, as a main component, a mixture of a polyolefin resin with an inorganic pigment, having at least one biaxially oriented base layer and formed on and bonded to a back surface of the sheet substrate, said sheet substrate and the front and back surface coating films satisfying the heat shrinkage relationships (1) and (2):

$$S_1/S_2 \leqq \tfrac{1}{2} \quad (1)$$

$$S_3 < S_1 \quad (2)$$

wherein $S_1$ represents a heat shrinkage of the front surface coating film, $S_2$ represents a sheet shrinkage of the back surface coating film, and $S_3$ represents a heat shrinkage of the sheet substrate, determined at a temperature of 100{2° C. for 10 minutes in accordance with Japanese Industrial Standard (JIS) No. K-6734-1975, 6.6 Heat Shrinkage Test.

The above-mentioned support sheet for a thermal transfer image-receiving sheet can be produced by the method of the present invention, which comprises coating front and back surfaces of a sheet substrate having a thickness of from 20 to 300 μm with multilayer plastic films each comprising, as a main component, a mixture of a polyolefin resin with an inorganic pigment and each having at least one biaxially oriented base layer, under tensions satisfying the relationship (3):

$$T_1/T_2 \leqq \tfrac{1}{2} \quad (3)$$

wherein $T_1$ represents a tension applied to the front surface coating film and $T_2$ represents a tension applied to the back surface coating film.

DESCRIPTION OF THE PREFERRED EMBODIMENTS

Figure 1:
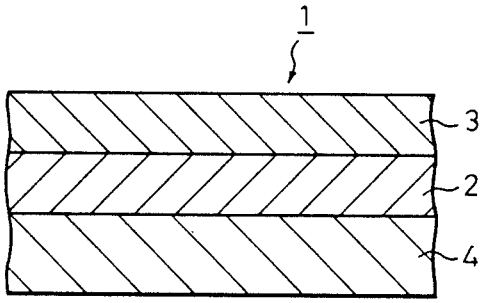
FIG. 1 is an explanatory cross-sectional profile of an embodiment of the support sheet of the present invention.

In an embodiment of the support sheet of the present invention as indicated in FIG. 1, a support sheet 1 consists of a substrate sheet 2, a front surface coating film layer 3 bonded to a front surface of the substrate sheet 2, and a back surface coating film layer 4 bonded to a back surface of the substrate sheet.

Figure 2:
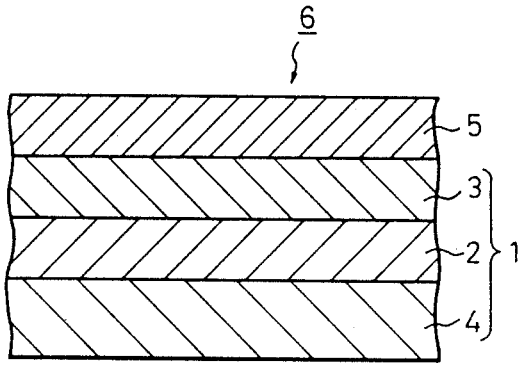
FIG. 2 is an explanatory cross-sectional profile of a thermal transfer image-receiving sheet including the support sheet indicated in FIG. 1.

In FIG. 2, the support sheet 1 of the present invention as shown in FIG. 1 is coated on the front surface thereof with a thermal transfer image-receiving layer 5 comprising, for example, a polyester resin, to provide a thermal transfer image-receiving sheet 6.

The sheet substrate usable for the support sheet of the present invention has a thickness of 20 to 300 μm, preferably 40 to 250 μm.

The sheet substrate usually comprises a member selected from paper sheets, coated paper sheets, and synthetic polymer resin films, for example, polyester films, polyolefin films, and polyamide films. The paper sheets include fine paper sheets, medium duality paper sheets, Japanese traditional paper sheets, and tissue paper sheets. The coated paper sheets include thin coated paper sheets, light weight coated paper sheets, and art paper sheets.

Preferably, the sheet substrate consists of a coated paper sheet consisting of a fine paper sheet or medium quality paper sheet and a coating layers formed on two surfaces of the paper sheet by applying a coating liquid comprising a pigment selected from kaolin, clay, calcium carbonate, aluminum hydroxide and plastic pigments, a binder material comprising at least one member selected from aqueous solutions of water-soluble polymeric materials, for example, starch and aqueous emulsions of synthetic polymeric materials, for example, styrene-butadiene copolymers.

The coated paper sheets usable for the support sheet of the present invention preferably has a weight of 50 to 200 g/m$^2$ including 4 to 80 g/m$^2$ of the coating layers. When the thickness of the sheet substrate is less than 20 μm, the resultant image-receiving sheet exhibits an unsatisfactory stiffness and resilience and thus cannot satisfactorily prevent the undesirable curling thereof when subjected to a thermal transfer printing operation. Also, when the thickness of the sheet substrate is more than 300 μm, the resultant image-receiving sheet exhibits an excessively large thickness, which increases a volume necessary for containing a predetermined number of the image-receiving sheets in a printer, and thus hinders a reduction in the size and weight of the printer.

In the support sheet of the present invention, the front and back surfaces of the sheet substrate are coated with front and back surface coating film layers, respectively. The surface coating films are multilayer plastic films comprising, as a main component, a mixture of a polyolefin resin and an inorganic pigment and having at least one biaxially oriented base layer, as disclosed in U.S. Pat. Nos. 4,318,950 and 4,075,050.

The polyolefin resin preferably comprises at least one member selected from polyethylene, polypropylene, polyobutene, and polypentene resins, and copolymer resins of two or more of the above-mentioned polymers. More preferably, the polyolefin resin comprises at least one member selected from high density polyethylene resins, low density polyethylene resins, polypropylene resins, and ethylene-propylene copolymer resins.

The inorganic pigment usable for the front and back surface coating films comprises at least one member selected from titanium dioxide, zinc sulfide, zinc oxide, light and heavy calcium carbonates, calcium sulfate, calcium sulfate, aluminum hydroxide, barium sulfate, clay, talc, kaolin, silica, and calcium silicate. The inorganic pigment in the front and back surface coating films is in a content of 5 to 70% by weight.

The front and back surface coating films can be produced by the processes of U.S. Pat. Nos. 4,318,950 and 4,075,050.

The multilayered structure of the plastic film can be formed by laminating at least one bi-axially oriented base sheet comprising an polyolefin resin and an inorganic pigment, and at least two paper-like coating layers consisting of mono-axially drawn polyolefin films and bonded to the two surfaces of the base sheet to provide a composite film having a multilayer-structure, or by laminating at least one base sheet, at least two paper-like coating sheets and an additional layer, for example, an additional top-coating layer, to increase the whiteness of the resultant composite film having a multilayer structure.

The above-mentioned multilayer plastic films are known as synthetic paper-like sheets and used for printing and hand-writing. The synthetic paper-like sheets are disadvantageous in that they have an unsatisfactorily low stiffness and resilience, and a high heat shrinkage. To eliminate or reduce the above-mentioned disadvantages, the synthetic paper-like sheet is laminated with another paper-like sheet, or with a polyester film or a paper sheet, and then with another paper-like sheet.

An attempt was made to use the synthetic paper-like sheet per se as an image-receiving sheet for a sublimating dye thermal transfer printing system, to improve the quality of the thermal transferred images or pictures. This attempt, however, was not successful because the synthetic paper-like sheet exhibited poorer thermal resistance than that necessary for a practical thermal transfer image-receiving sheet, and thus, when used in the printing operation, the synthetic paper-like sheet was easily shrunk and curled.

Accordingly, in the image-receiving sheet of the present invention, the front and back surface coating film layers are supported by the sheet substrate.

Usually, the front surface coating film layer has a thickness of 10 to 200 μm, preferably 20 to 180 μm, and the back surface coating film layer has a thickness of 10 to 200 μm, preferably 20 to 180 μm.

The front and back surface coating films are bonded to the sheet substrate surfaces by a dry laminating method, through adhesive agent layers. The adhesive agent is preferably selected from high heat-resistant dry laminating adhesive resin materials, for example, polyether resin adhesive materials and polyester resin adhesive materials.

In the support sheet of the present invention, the heat shrinkage $S_1$ of the front surface coating film corresponds to ½ or less of the heat shrinkage $S_2$ of the back surface coating film, and preferably is 0.2% or less, more preferably 0.1% or less. The low heat shrinkage film usable as a front surface coating film can be produced by bringing a drawn plastic film having a stress created by the drawing procedure into contact with a heating medium, for example, a heating roll, while maintaining the plastic film in a relaxed condition under which the plastic film can thermally shrink, to release the stress and to control the heat shrinkage of the plastic film to a desired low level.

All the heat shrinkages mentioned in the specification were determined in accordance with the test method set forth in Japanese Industrial Standard (JIS) K6734-1975, 6.6 Heat Shrinkage Test.

In this test method, a test piece is placed horizontally in a tester, heated at a temperature of 100±2° C. for 10 minutes, and then cooled to room temperature. The heat shrinkage of the test piece is calculated in accordance with the equation:

$$S = \frac{l_2 - l_1}{l_1} \times 100$$

wherein S represents the % of heat shrinkage of the test piece, $l_1$ represents a gauge length of the test piece before heating, and $l_2$ represents a gauge length of the test piece after heating.

Depending on the heating condition for the image-receiving sheet in the thermal transfer printing operation, sometimes the heat shrinkage of the back surface coating film must be controlled to a predetermined level to prevent the creation of curl in the sheet. Even in this case, the heat shrinkage $S_1$ of the front surface coating film is preferably controlled to a level corresponding to a ½ or less of the $S_2$ of the back surface coating film. If $S_1$ is more than ½ $S_2$, the resultant image-receiving sheet is easily curled and wrinkles are produced during the thermal transfer printing procedure.

In the support sheet of the present invention, it is not necessary for the heat shrinkages of all the component layers to be small, but it is necessary to control the heat shrinkage $S_2$ of the back surface coating film to a value of 2 times or more the heat shrinkage $S_1$ of the front surface coating film, to provide a back surface coating film layer having a relatively large heat shrinkage $S_2$, which effectively prevents the formation of curls and wrinkles on the image-receiving sheet during the thermal transfer printing operation.

Preferably, the back surface coating film has a heat shrinkage of 0.2% to 2%.

In the support sheet of the present invention, the front surface coating film may have a different thickness from that of the back surface coating film.

Preferably, the sheet substrate and the front and back surface coating films satisfy the following thickness relationship:

$$10 \leqq X_3 - X_1 \leqq 40$$
$$100 \leqq X_1 + X_2 + X_3 \leqq 370$$
$$X_1 \geqq 30$$
$$20 \leqq X_2 \leqq 300$$

where $X_2$ represents a thickness in μm of the sheet substrate, $X_1$ represents a thickness in μm of a thinner one of the front and back surface coating films, and $X_3$ represents a thickness in μm of the other of the front and back surface coating films, which is thicker than the thinner film.

When the front and back surface coating films have a different thickness, the thicker coating film layer exhibits a larger shrinking force than that of the thinner (other) coating film layer, and therefore, when an image-receiving sheet is heated only on the front surface coating film layer thereof in the thermal transfer printing operation, this uneven heating for the image-receiving sheet only on one side thereof creates a stress in the sheet and causes the sheet to be curled or wrinkled. The stress created in the sheet can be offset by the difference in shrinking force between the front and back surface coating film layers, and thus the formation of curls in and wrinkles on the resultant image-receiving sheet is prevented.

In the support sheet of the present invention, the sheet substrate may comprise an adhesive layer composed of an adhesive material, and at least one intermediate layer comprising a pigment and a binder resin material and formed on at least one side of the adhesive layer.

Figure 3:
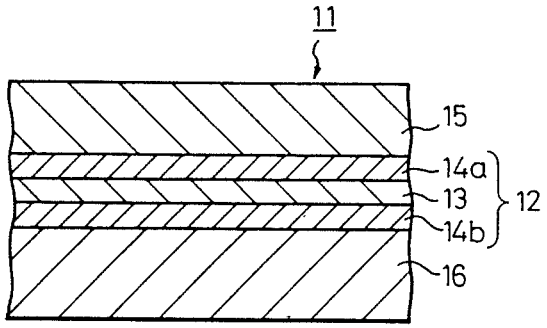
FIG. 3 is an explanatory cross-sectional profile of another embodiment of the support sheet of the present invention.

Referring to FIG. 3, a support sheet 11 consists of a sheet substrate 12, which consists of an adhesive layer 13, a front side intermediate layer 14*a*, and a back side intermediate layer 14*b*, a front surface coating film layer 15 bonded to the front side intermediate layer 14*a*, and a back surface coating film layer 16 bonded to the back side intermediate layer 14*b*. In the sheet substrate 12, the front and back side intermediate layers 15 and 16 are bonded together by the adhesive layer 13.

Figure 4:
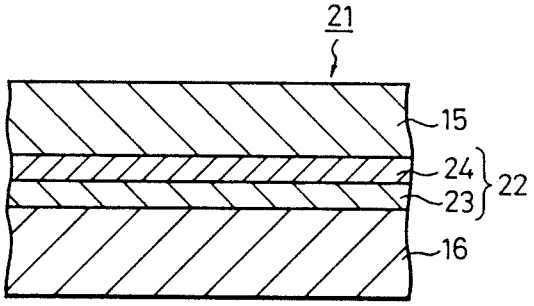
FIG. 4 is an explanatory cross-sectional profile of a further embodiment of the support sheet of the present invention.

In FIG. 4, a support sheet 21 consists of a sheet substrate 22, which consists of an adhesive layer 23 and an intermediate layer 24 bonded to the front side surface of the adhesive layer 23, a front surface coating film layer 15 bonded to the intermediate layer 24, and a back surface coating film layer 16 bonded to the adhesive layer 23.

Figure 5:
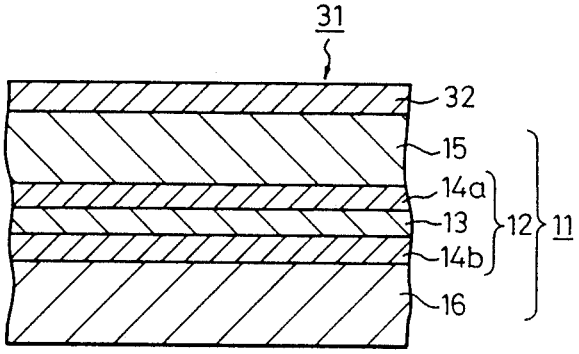
FIG. 5 is an explanatory cross-sectional profile of another thermal transfer image-receiving sheet including the support sheet shown in FIG. 3.

Referring to FIG. 5, an image-receiving sheet 31 consists of the same support sheet 11 as shown in FIG. 3 and an image-receiving layer 32 bonded to the front surface coating film layer 15 in the support sheet 11.

In the support sheet as shown in FIGS. 3 or 4, the intermediate layer comprises a mixture of a pigment and a binder resin material, and preferably has a thickness of 10 to 50 μm, more preferably 10 to 45 μm. The pigment in the intermediate layer is effective for enhancing the heat resistance of the support sheet, and preferably has an oil absorption of 50 ml/100 g or more, more preferably from 60 to 300 ml/100 g. The pigment preferably comprises at least one member selected from clay, calcium carbonate, finely pulverized silica, and kaolin which has excellent heat-insulating properties. More preferably, the pigment consists of at least one member selected from cylindrical Aragonite type precipitated calcium carbonate, calcinated kaolin, and finely pulverized silica, having an oil absorption of 50 ml/100 g or more. This type of pigment effectively increases the heat insulating property of the resultant image-receiving sheet, and therefore, the resultant image-receiving sheet can record clear colored images having a uniform hue and color density. Usually, the pigment is contained in an amount of 10 to 90% by weight in the intermediate layer.

The binder resin material usable for the intermediate layer is not restricted to a specific type of resin as long as it is chemically and physically stable under the thermal conditions in which the resultant image-receiving sheet is employed. Generally, the binder resin material comprises at least one member selected from styrene-butadiene copolymers, methyl methacrylate-styrene-butadiene copolymers, vinyl acetate homopolymers and copolymers, and acrylic homopolymers and copolymers.

In the preparation of the intermediate layer, a mixture of a pigment with a binder resin material in the form of a solution or emulsion is coated on an adhesive layer or a front or back surface coating film, and dried.

The binder resin material may contain, in addition to the above-mentioned polymers, a water-soluble polymeric material, for example, polyvinyl alcohol, starch or casein.

The adhesive layer preferably consists essentially of at least one member selected from polyether resin type adhesive agents, and polyester resin type adhesive agents. More preferably, the adhesive agent is a high heat resistant dry laminating adhesive material comprising, as a principal component, an aromatic polyester resin.

Preferably, the adhesive layer has a thickness of 1 to 30 μm, more preferably 3 to 25 μm.

In the preparation of the support sheet, an intermediate layer is formed on each of front and back surface coating films and the intermediate layer on the front surface coating film is bonded to the other intermediate layer on the back surface coating film through an adhesive layer.

Alternatively, an intermediate layer formed on a front or back surface coating film is bonded to the other surface coating film through an adhesive layer.

The intermediate layer may be formed from a film comprising a mixture of a pigment and a binder resin material.

The support sheet of the present invention can be produced by the method which comprises coating front and back surfaces of a sheet substrate having a thickness of from 20 to 300 μm with coating films. The coating films are multilayer plastic films comprising, as a main component, a mixture of a polyolefin resin with an inorganic pigment and having at least one biaxially oriented base layer. The coating operation of the sheet substrate with the coating films is carried out under tensions satisfying the relationship:

$$T_1/T_2 \leqq \tfrac{1}{2}, \text{ preferably } T_1/T_2 \leqq \tfrac{1}{3}$$

wherein $T_1$ represents a tension applied to the front surface coating film and $T_2$ represents a tension applied to the back surface coating film.

When the ratio $T_1/T_2$ is more than $\frac{1}{2}$, the resultant support sheet cannot prevent the formation of curls on an image-receiving sheet produced from the support sheet during the thermal transfer printing operation.

The plastic resin film can be bonded to the sheet substrate either by an adhesive agent or by a thermal melt bonding method.

In the coating operation, the plastic film is preferably stretched at an elongation of 0.1 to 0.5%, based on the length of the non-stretched plastic film.

The tension ratio $T_1/T_2$ of $\frac{1}{2}$ or less results in the creation of a larger residual shrinking stress in the back surface coating film layer than in the front surface coating film layer.

When the image-receiving sheet is subjected to a thermal transfer printing operation, the larger residual shrinking stress in the back surface coating film layer is offset by a heat shrinking stress created in the front surface coating film layer, which is heated by a thermal head in the thermal transfer printing operation, and thus the formation of curls or wrinkles in the resultant support sheet is prevented.

EXAMPLES

The present invention will be further explained with reference to the following examples.

In the examples the image-receiving properties and the thermal curling properties of the resultant support sheets and image-receiving sheets were tested and evaluated in the following manner.

The support sheet was directly subjected, as an image-receiving sheet, to printing by an ink thermal transfer printer (trademark: Ink Printer CHC-35, made by SHINKO DENKI K.K.).

The image-receiving sheet was subjected to printing by a sublimating dye thermal transfer printer (trademark: Video Printer VY-50, made by HITACHI SEISAKUSHO).

In the sublimating dye thermal transfer printer, yellow, magenta and cyan dye ink sheets each composed of a substrate consisting of a polyester film having a thickness of a 6 μm and a wax-colored ink coating layer formed on a surface of the substrate and containing 50% by weight of a filler consisting of carbon black were used. A thermal head of the printer was heated stepwise at a predetermined heat quantity, and the heat-transferred images were formed in a single color or a mixed (superposed) color provided by superposing yellow, magenta, and cyan colored images, on the test sheet.

In each printing operation, the clarity (sharpness) of the images, the evenness of shading of the dots, the evenness of shading of close-printed portions, and the resistance of the sheet to thermal curling were observed by the naked eye, and evaluated as follows:

| Class | Evaluation |
|---|---|
| 5 | Excellent |
| 4 | Good |
| 3 | Satisfactory |
| 2 | Not satisfactory |
| 1 | Bad |

Also, the support sheets and the image-receiving sheets are heated at a temperature of 120° C. for 10 minutes and kept standing at room temperature, and the resistance of the sheet to thermal curling was observed by the naked eye and evaluated in the same manner as mentioned above.

EXAMPLE 1

A multilayer plastic film, available under a trademark of Yupo FPG 80, made by OJI YUKA GOSEISHI K.K., comprised, as a main component, a mixture of calcium carbonate and a polypropylene resin, and having a thickness of 80 μm and a heat shrinkage of 0.5% in the longitudinal direction thereof, was heat relaxed at a temperature of 80° C. for 24 hours. The relaxed film had a decreased heat shrinkage in the longitudinal direction of 0.2% and was used as a front surface coating film. The same type of film as mentioned above, but which was not relaxed, was used as a back surface coating film.

The front surface coating film was bonded to a front surface of a sheet substrate consisting of a fine paper sheet, available under a trademark of OK FORM PAPER and made by OJI PAPER CO., and had a weight of 64 g/m$^2$ and a heat shrinkage in longitudinal direction of 0.01%, with a polyester resin type adhesive agent by a dry laminating method. Also, the back surface coating film was bonded to the back surface of the sheet substrate in the same manner as mentioned above. A support sheet was provided.

The front surface of the support sheet was coated with a solution of a polyester resin, available under a trademark of VYLON 200 and made by TOYOBO CO., in toluene and the coated solution layer was solidified to form an image-receiving layer having a weight of 5 g/m$^2$.

A sublimating dye thermal transfer image-receiving sheet was provided.

The support sheet and the image-receiving sheet were subjected to the above-mentioned printing tests, and the results of the tests are shown in Tables 1 and 2.

EXAMPLE 2

The same procedures as mentioned in Example 1 were carried out except that the sheet substrate consisted of a coated paper sheet having a weight of 72 g/m$^2$ and a heat shrinkage in the longitudinal direction of 0.01%.

EXAMPLE 3

A multilayer plastic film, available under a trademark of Yupo FPG 60 and made by OJI YUKA GOSEISHI K K., comprising, as a main component, a mixture of a polypropylene resin and calcium carbonate, and having a thickness of 60 μm and a heat shrinkage in longitudinal direction of 0.5%, was heat relaxed at a temperature of 90° C. for 24 hours. The relaxed film had a heat shrinkage in the longitudinal direction of 0.08% and was used as a front surface coating film.

The same type of film as mentioned above was heat relaxed at a temperature of 75° C. for 24 hours. The relaxed film exhibited a heat shrinkage in the longitudinal direction of 0.35%, and was used as a back surface coating film.

The front and back coating films were coated on the front and back surfaces of a sheet substrate consisting of a coated paper sheet having a weight of 64 g/m$^2$ and a heat shrinkage in the longitudinal direction of 0.01%, in the same manner as mentioned in Example 1.

The resultant support sheet was converted to an image-receiving sheet in the same manner as mentioned in Example 1, and the support sheet and the image-receiving sheet were subjected to the same tests as mentioned in Example 1.

The test results are shown in Tables 1 and 2.

COMPARATIVE EXAMPLE

The same procedures as mentioned in Example 1 were carried out except that the front and back surfaces of the sheet substrate were coated by the same type of non-relaxed films as mentioned in Example 1.

The test results are shown in Tables 1 and 2.

COMPARATIVE EXAMPLE 2

An oriented polypropylene (OPP) film having a thickness of 75 μm and a heat shrinkage in the longitudinal direction of 1% was used as a support sheet, and this support sheet was converted to an image-receiving sheet in the same manner as mentioned in Example 1. The support sheet and the image-receiving sheet were subjected to the same tests as mentioned above.

The test results are shown in Tables 1 and 2.

COMPARATIVE EXAMPLE 3

The same procedures as described in Example 1 were carried out except that a non-relaxed film, available under a trademark of Yupo FPG 150 and made by OJI YUKA GOSEISHI K.K., comprising a mixture of a polypropylene resin with calcium carbonate and having a multilayered structure, a thickness of 150 μm, and a heat shrinkage in the longitudinal direction of 1%, was used as a support sheet.

The test results are shown in Tables 1 and 2.

TABLE 1

| | Item Support sheet (Ink printer) | | | |
|---|---|---|---|---|
| Example No. | Clarity of colored images | Evenness of images | Resistance to curling in printing operation | Resistance to curling at 120° C. |
| Example 1 | 5 | 5 | 5 | 4 |
| Example 2 | 4 | 4 | 4 | 5 |
| Example 3 | 5 | 5 | 4 | 4 |
| Comparative Example 1 | 5 | 5 | 2 | 2 |
| Comparative Example 2 | 3 | 3 | 2 | 2 |

TABLE 1-continued

| Example No. | Item Support sheet (Ink printer) Clarity of colored images | Evenness of images | Resistance to curling in printing operation | Resistance to curling at 120° C. |
|---|---|---|---|---|
| Comparative Example 3 | 5 | 5 | 1 | 1 |

TABLE 2

| Example No. | Item Image-receiving sheet (Sublimating dye printer) Clarity of colored images | Evenness of images | Resistance to curling in printing operation | Resistance to curling at 120° C. |
|---|---|---|---|---|
| Example 1 | 5 | 5 | 4 | 4 |
| Example 2 | 4 | 4 | 4 | 4 |
| Example 3 | 5 | 5 | 5 | 5 |
| Comparative Example 1 | 5 | 5 | 2 | 2 |
| Comparative Example 2 | 3 | 3 | 1* | 2 |
| Comparative Example 3 | 3 | 3 | 1* | 1* |

Note: *Practically useless

EXAMPLE 4

The same procedures as those described in Example 1 were carried out, with the following exceptions.

The front surface coating film consisted of the same multilayer polypropylene film (Yupo FPG 80) having a thickness of 80 μm as that mentioned in Example 1, except that it was not relaxed and thus had a heat shrinkage in the longitudinal direction of 0.5%.

The back surface polypropylene film consisted of a multilayer polypropylene film (available under a pigment (calcium carbonate) dispersed in a polypropylene resin matrix and having a thickness of 110 μm, and a heat shrinkage in the longitudinal direction of 0.8%.

The sheet substrate consisted of a fine paper sheet available under a trademark of OK FORM PAPER SHEET and made by OJI PAPER CO., having a weight of 64 g/m$^2$, a thickness of 80 μm, and a heat shrinkage in the longitudinal direction of 0.1%.

The front and back surface coating films were respectively bonded to the front and back surfaces of the sheet substrate with a polyester resin type adhesive agent, available under a trademark of Adhesive Agent S-3911 and made by TOA GOSEI KAGAKU KOGYO K.K., by a dry laminating method.

The resultant support sheet was coated with a thermal transfer image-receiving layer in the same manner as described in Example 1.

The resultant image-receiving sheet was subjected to the same printing tests by the ink thermal transfer printer (Printer CHC-35) and by the sublimating dye thermal transfer printer (Video Printer VY-50) as described hereinbefore.

The test results are shown in Tables 3 to 4.

EXAMPLE 5

The same procedures as described in Example 4 were carried out, with the following exceptions.

The front surface coating film consisted of an oriented polypropylene (OPP) film (trademark: PYLENE TO, made by Toyobo K.K.) having a thickness of 50 μm and a heat shrinkage in the longitudinal direction of 2%.

The back surface coating film consisted of a multilayer polyolefin film (trademark: Yupo FPG 60) comprising an inorganic pigment (calcium carbonate) dispersed in a polypropylene resin matrix and having a thickness of 60 μm, and a heat shrinkage in the longitudinal direction of 0.35%.

The sheet substrate consisted of a coated paper sheet having a thickness of 50 μm, a weight of 54 g/m$^2$, a heat shrinkage in the longitudinal direction of 0.01%, and a weight of the coating layer of 7 g/m$^2$.

The test results are shown in Tables 3 and 4.

EXAMPLE 6

The same procedures as those described in Example 4 were carried out except that the sheet substrate consisted of a polyethylene terephthalate resin sheet having a thickness of 20 μm, a weight of 26 g/m$^2$, and a heat shrinkage in the longitudinal direction of 0.01%.

The test results are shown in Tables 3 and 4.

EXAMPLE 7

The same procedure as those described in Example 4 were carried out, with the following exceptions.

The front surface coating film consisted of a multiplayer polyolefin film (trademark: YUPO SGG 60, made by OJI YUKA GOSEISHI K.K.) comprising an inorganic pigment (calcium carbonate) dispersed in a polyolefin resin matrix and having a thickness of 60 μm, and a heat shrinkage in the longitudinal direction of 0.3%.

The back surface coating film consisted of a multilayer polyolefin film (trademark: YUPO FPG 150, OJI YUKA GOSEISHI K.K.) comprising an inorganic pigment (calcium carbonate) dispersed in a polyolefin resin matrix) and having a thickness of 150 μm, and a heat shrinkage in the longitudinal direction of 1%.

The sheet substrate consisted of the same polyethylene terephthalate resin film as described in Example 6.

The test results are shown in Tables 3 and 4.

COMPARATIVE EXAMPLE 4

The same procedures as described in Example 4 were carried out except that a sheet substrate was not used and the front surface coating film (YUPO FPG 80) was directly bonded to the back surface coating film (YUPO FPG 100).

The test results are shown together with the test results of Comparative Examples 2, 3 and 1 in Tables 3 and 4.

TABLE 3

| Example No. | Item Ink printer Clarity of images | Evenness of images | Resistance to curling in printing operation | Resistance to curling at 120° C. |
|---|---|---|---|---|
| Example 4 | 5 | 5 | 5 | 5 |
| Example 5 | 4 | 4 | 5 | 4 |
| Example 6 | 5 | 5 | 5 | 5 |
| Example 7 | 5 | 5 | 4 | 3 |
| Comparative Example 4 | 5 | 5 | 2 | 1 |
| Comparative Example 2 | 3 | 3 | 2 | 2 |
| Comparative Example 3 | 5 | 5 | 1 | 1 |
| Comparative | 5 | 5 | 2 | 2 |

TABLE 3-continued

| Example No. | Item Ink printer | | | |
|---|---|---|---|---|
| | Clarity of images | Evenness of images | Resistance to curling in printing operation | Resistance to curling at 120° C. |
| Example 1 | | | | |

TABLE 4

| Example No. | Item Sublimating dye printer | | | |
|---|---|---|---|---|
| | Clarity of images | Evenness of images | Resistance to curling in printing operation | Resistance to curling at 120° C. |
| Example 4 | 5 | 5 | 5 | 5 |
| Example 5 | 4 | 4 | 5 | 4 |
| Example 6 | 5 | 5 | 5 | 5 |
| Example 7 | 5 | 5 | 3 | 3 |
| Comparative Example 4 | 5 | 5 | 1 | 1 |
| Comparative Example 5 | 3 | 3 | 1 | 1 |
| Comparative Example 6 | 5 | 5 | 1 | 2 |
| Comparative Example 7 | 5 | 5 | 2 | 2 |

EXAMPLE 8

Front and back surfaces of a sheet substrate consisting of a fine paper sheet (trademark: OK FORM PAPER SHEET, made by OJI PAPER CO.) having a weight of 64 g/m$^2$, a thickness of 80 μm, and a heat shrinkage in the longitudinal direction of 0.1%, were coated respectively with front and back surface coating films each composed of the same multilayer polypropylene film (YUPO FPG 80) as described in Example 4 by a dry laminating method, under the following tension.

In the coating procedure, tension was applied to the front surface coating film in the longitudinal direction thereof, at a tension $T_1$ of 1.0 kgf and to the back surface coating film at a tension $T_2$ of 3.0 kgf; i.e., the tension ratio $T_1/T_2$ was ⅓. The front and back surface coating films stretched under the above-mentioned tensions exhibited heat shrinkages in the longitudinal direction of 0.6% and 1.4%, respectively.

The resultant support sheet was converted to an image-receiving sheet in the same manner as described in Example 1.

The image-receiving sheet was subjected to the same printing tests as described in Example 4.

The test results are indicated in Tables 5 and 6, together with the test results of comparative Example 3.

EXAMPLE 9

The same procedures as described in Example 8 were carried out except that the tensions $T_1$ and $T_2$ applied to the front and back surface coating films in the longitudinal direction thereof were as follows.

| |
|---|
| $T_1$ = 1.0 kgf |
| $T_2$ = 4.0 kgf |
| $T_1/T_2$ = ¼ |

The heat shrinkages $S_1$ and $S_2$ in the longitudinal direction of the front and back surface coating film stretched under the above-mentioned tensions were as follows.

| |
|---|
| $S_1$ = 0.6% |
| $S_2$ = 1.8% |
| $S_1/S_2$ = 0.33 |

The test results are indicated in Tables 5 and 6.

EXAMPLE 10

The same procedures as those described in Example 8 were carried out except that the tensions $T_1$ and $T_2$ applied to the front and back surface coating films in the longitudinal direction thereof, and the heat shrinkages $S_1$ and $S_2$ of the films stretched under the above-mentioned tensions, in the longitudinal direction thereof, were as follows.

| |
|---|
| $T_1$ = 1.0 kgf |
| $T_2$ = 2.0 kgf |
| $T_1/T_2$ = ½ |
| $S_1$ = 0.6% |
| $S_2$ = 1.2% |
| $S_1/S_2$ = 0.5 |

The test results are shown in Tables 5 and 6.

EXAMPLE 11

The same procedures as those described in Example 8 were carried out except that the sheet substrate consisted of a polyethylene terephthalate resin sheet having a thickness of 18 μm and a heat shrinkage in the longitudinal direction of 0.05%.

The test results are shown in Tables 5 and 6.

COMPARATIVE EXAMPLE 5

The same procedures as those described in Example 8 were carried out except that the tension $T_2$ applied to the back surface coating film was 1.0 kgf, and thus $T_1T_2=1$ and the heat shrinkage $S_2$ in the longitudinal direction of the tensed back surface coating film was 0.6%, and therefore, $S_1S_2=1$.

The test results are shown in Tables 5 and 6.

TABLE 5

| Example No. | Item Ink printer | | | |
|---|---|---|---|---|
| | Clarity of images | Evenness of images | Resistance to curling in printing operation | Resistance to curling at 120° C. |
| Example 8 | 5 | 5 | 4 | 4 |
| Example 9 | 5 | 5 | 3 | 3 |
| Example 10 | 5 | 5 | 3 | 3 |
| Example 11 | 5 | 5 | 4 | 4 |
| Comparative Example 3 | 5 | 5 | 1 | 1 |
| Comparative Example 5 | 5 | 5 | 2 | 2 |

TABLE 6

| Example No. | Item Sublimating dye printer | | | |
|---|---|---|---|---|
| | Clarity of images | Evenness of images | Resistance to curling in printing operation | Resistance to curling at 120° C. |
| Example 8 | 5 | 5 | 4 | 4 |
| Example 9 | 5 | 5 | 3 | 3 |

TABLE 6-continued

| Example No. | Item Sublimating dye printer | | | |
|---|---|---|---|---|
| | Clarity of images | Evenness of images | Resistance to curling in printing operation | Resistance to curling at 120° C. |
| Example 10 | 5 | 5 | 3 | 3 |
| Example 11 | 5 | 5 | 4 | 4 |
| Comparative Example 3 | 3 | 3 | 1 | 1 |
| Comparative Example 5 | 5 | 5 | 2 | 2 |

EXAMPLE 12

A resinous composition (1) for a front intermediate layer was prepared as follows:

| Component | Part by weight |
|---|---|
| Calcinated clay (*2) | 100 |
| Carboxyl-modified styrene-butadiene copolymer latex | 20 |
| Dispersing agent (*3) | 2 |

Note:
(*)2 . . . Having an oil absorption of 80 ml/100 g
(*)3 . . . Consisting of sodium polyacrylate The resinous composition was coated in an amount of 20 g/m$^2$ on a lower surface of a front surface coating layer consisting of the same polypropylene film (UPO FPG 80) as described in Example 4, and dried to form an intermediate layer having a thickness of 15 μm.

The surface of the intermediate layer on the front surface coating film was bonded to an upper surface of a back surface coating film consisted of the same polypropylene film (YUPO FPG 80) as described in Example 4, through an adhesive layer consisting of the same polyester resin type adhesive agent as described in Example 4 and having a dry weight of 5 g/m$^2$ and a thickness of 4 μm.

The sheet substrate consisting of the front intermediate layer and the adhesive layer had a thickness of 90 μm and exhibited a heat shrinkage in the longitudinal direction of 0.15%.

The resultant support sheet was converted to an image-receiving sheet in the same manner as described in Example 1.

The support sheet and the image-receiving sheet were subjected to the same printing tests as mentioned in Example 1.

The results are shown in Tables 7 and 8.

EXAMPLE 13

The same procedures as those described in Example 12 were carried out except that the upper surface of the back surface coating sheet was coated by the resinous composition (1) to form a back intermediate layer and the front intermediate layer on the front surface coating film was bonded to the back intermediate layer on the back surface coating film through the same adhesive layer as mentioned in Example 12. The resultant sheet substrate consisting of the front and back intermediate layers and the adhesive layer had a thickness of 183 μm and exhibited a heat shrinkage in longitudinal direction of 0.1%.

The test results are shown in Tables 7 and 8.

EXAMPLE 14

The same procedures as described in Example 13 were carried out except that the resinous composition (1) was replaced by a resinous composition (2) having the following composition.

| Component | Part by weight |
|---|---|
| Amorphous fine silica particles (*4) | 100 |
| Polyvinyl alcohol | 20 |

Note:
(*)4 . . . Having an oil absorption of 200 ml/100 g

The resultant front and back intermediate layers each had a weight of 20 g/m$^2$ and a thickness of 25 μm.

The resultant sheet substrate had a thickness of 213 μm and a heat shrinkage in the longitudinal direction of 0.1%.

The test results are shown in Tables 7 and 8.

COMPARATIVE EXAMPLE 6

The same procedures as described in Example 12 were carried out except that the front and back surface coating films (YUPO FPG 80) were directly bonded to each other through the same adhesive layer as described in Example 12 by a dry laminate method to provide a comparative support sheet.

The test results are shown in Tables 7 and 8 together with the test results of Comparative Example 3.

COMPARATIVE EXAMPLE 7

The same procedures as described in Example 12 were carried out except that the support sheet consisted of the front surface coating film (YUPO FPG 80) and the front intermediate layer bonded to the film.

The test results are shown in Tables 7 and 8.

TABLE 7

| Example No. | Item Support sheet, Ink printer | | | |
|---|---|---|---|---|
| | Clarity of images | Evenness of images | Resistance to curling in printing operation | Resistance to curling at 120° C. |
| Example 12 | 4 | 5 | 4 | 3 |
| Example 13 | 4 | 5 | 4 | 3 |
| Example 14 | 5 | 5 | 5 | 3 |
| Comparative Example 3 | 5 | 5 | 1 | 1 |
| Comparative Example 6 | 5 | 4 | 2 | 3 |
| Comparative Example 7 | 5 | 4 | 3 | 2 |

TABLE 8

| Example No. | Item Image-receiving sheet, Sublimating dye printer | | | |
|---|---|---|---|---|
| | Clarity of images | Evenness of images | Resistance to curling in printing operation | Resistance to curling at 120° C. |
| Example 12 | 4 | 5 | 3 | 3 |
| Example 13 | 4 | 5 | 4 | 3 |
| Example 14 | 5 | 5 | 4 | 3 |
| Comparative Example 3 | 5 | 5 | 1 | 2 |
| Comparative Example 6 | 5 | 4 | 1 | 2 |
| Comparative | 5 | 4 | 2 | 2 |

TABLE 8-continued

| Example No. | Item Image-receiving sheet, Sublimating dye printer | | | |
|---|---|---|---|---|
| | Clarity of images | Evenness of images | Resistance to curling in printing operation | Resistance to curling at 120° C. |
| Example 7 | | | | |

We claim:

1. A support sheet for a thermal transfer image-receiving sheet, comprising:

(A) a sheet substrate having a thickness of 20 to 300 μm;

(B) a front surface coating film layer consisting of a multilayer film comprising at least one biaxially oriented base layer having as a main component a mixture of a polyolefin resin with an inorganic pigment, said surface coating being formed on and bonded to a front surface of the sheet substrate; and (C) a back surface coating film layer consisting of a multilayer film comprising at least one biaxially oriented base layer having as a main component a mixture of a polyolefinic resin with an inorganic pigment, said surface coating being formed on and bonded to a back surface of the sheet substrate, said sheet substrate and the front and back surface coating films satisfying heat shrinkage relationships (1) and 2):

$$S_1S_2 \leqq \tfrac{1}{2} \quad (1)$$

$$S_3 < S_1 \quad (2)$$

wherein $S_1$ represents a heat shrinkage of the front surface coating film, $S_2$ represents a sheet shrinkage of the back surface coating film, and $S_3$ represents a heat shrinkage of the sheet substrate, determined at a temperature of 100±2° C. for 10 minutes in accordance with Japanese Industrial Standard (JIS) K-6734-1975, 6.6 Heat Shrinkage Test.

2. The support sheet as claimed in claim 1, wherein the sheet substrate comprises a member selected from the group comprising paper sheets, coated paper sheets, polyester films, polyolefin films and polyamide films.

3. The support sheet as claimed in claim 1, wherein the sheet substrate has a heat shrinkage of 0.1% or less.

4. The support sheet as claimed in claim 1, wherein the front surface coating film has a heat shrinkage of 0.2% or less.

5. The support sheet as claimed in claim 1, wherein the back surface coating film has a heat shrinkage of 0.2 to 2%.

6. The support sheet as claimed in claim 1, wherein the front surface coating layer has a thickness of 10 to 200 μm.

7. The support sheet as claimed in claim 1, wherein the back surface coating layer has a thickness of 10 to 200 μm.

8. The support sheet as claimed in claim 1, wherein the thickness of the front surface coating film is not the same as the thickness of the back surface coating film.

9. The support sheet as claimed in claim 8, wherein the sheet substrate and the front and back surface coating films satisfy the following thickness relationships:

$$10 \leqq X_3 - X_1 \leqq 40$$
$$100 \leqq X_1 + X_2 + X_3 \leqq 370$$
$$X_1 \geqq 30$$
$$20 \leqq X_2 \leqq 300$$

wherein $X_2$ represents a thickness in μm of the sheet substrate, $X_1$ represents a thickness in μm of a thinner of the front and back surface coating films, and $X_3$ represents a thickness in μm of the other of the front and back surface coating films which is thicker than the thinner surface coating.

10. The support sheet as claimed in claim 1, wherein the sheet substrate comprises an adhesive layer of an adhesive material; and at least one intermediate layer comprising a pigment and a binder resin material and formed on at least one side of the adhesive layer.

11. The support sheet as claimed in claim 10, wherein the intermediate layer has a thickness of from 10 to 50 μm.

12. The support sheet as claimed in claim 10, wherein the pigment in the intermediate layer has an oil absorption of 50 ml/100 g or more.

13. The support sheet as claimed in claim 10, wherein the pigment in the intermediate layer comprises at least one member selected from precipitated calcium carbonate, calcinated kaolin and finely pulverized silica.

14. The support sheet as claimed in claim 10, wherein the binder resin material comprises at least one member selected from the group consisting of styrene-butadiene copolymers, methyl methacrylate-styrene-butadiene copolymers, vinyl acetate homopolymers and copolymers and acrylic homopolymers and copolymers.

15. The support sheet as claimed in claim 10, wherein the adhesive agent consists essentially of at least one member selected from the group consisting of polyether resin adhesive agents and polyester resin adhesive agents.

16. The support sheet as claimed in claim 10, wherein the adhesive layer has a thickness of from 1 to 30 μm.

* * * * *

UNITED STATES PATENT AND TRADEMARK OFFICE

CERTIFICATE OF CORRECTION

PATENT NO. : 4,971,950

DATED : November 20, 1990

INVENTOR(S) : Masaru KATO et al

It is certified that error appears in the above-identified patent and that said Letters Patent is hereby corrected as shown below:

On the cover page, Item [56], Under U.S. Patent Documents, "4,778,282" should read -- 4,778,782 --.

Column 3, line 17, "100{2°C." should read -- 100±2°C -- .

Claim 1, column 17, line 32, delete "2)", and insert therefor -- (2) --.

Claim 1, column 17, line 33, delete "$S_1S_2 \leqq \frac{1}{2}$", and insert therefor -- $S_1/S_2 \leqq \frac{1}{2}$ --.

Signed and Sealed this

Twenty-seventh Day of October, 1992

*Attest:*

DOUGLAS B. COMER

*Attesting Officer*

*Acting Commissioner of Patents and Trademarks*